US010895112B2

(12) United States Patent
Krelifaoui

(10) Patent No.: US 10,895,112 B2
(45) Date of Patent: Jan. 19, 2021

(54) SLOPE COMPENSATION SYSTEM FOR ROTARY DRILL MACHINES

(71) Applicant: Caterpillar Inc., Deerfield, IL (US)

(72) Inventor: Mohamed Krelifaoui, Montréal (CA)

(73) Assignee: Caterpillar Inc., Peoria, IL (US)

( * ) Notice: Subject to any disclaimer, the term of this patent is extended or adjusted under 35 U.S.C. 154(b) by 349 days.

(21) Appl. No.: 15/951,863

(22) Filed: Apr. 12, 2018

(65) Prior Publication Data

US 2019/0316417 A1 Oct. 17, 2019

(51) Int. Cl.
*E21B 7/02* (2006.01)
*B66F 3/46* (2006.01)

(52) U.S. Cl.
CPC ..... *E21B 7/024* (2013.01); *B66F 3/46* (2013.01)

(58) Field of Classification Search
CPC combination set(s) only.
See application file for complete search history.

(56) References Cited

U.S. PATENT DOCUMENTS 3,613,805 A 10/1971 Lindstad
3,625,483 A 12/1971 Stoner
4,679,489 A * 7/1987 Jasinski ..... E21B 7/022 175/24
5,653,297 A 8/1997 Whisenhunt
9,114,782 B2 8/2015 Warr
2017/0234119 A1 8/2017 Allen et al.

FOREIGN PATENT DOCUMENTS

CA 917137 A 12/1972
CA 2129590 A1 1/1996

* cited by examiner

*Primary Examiner* — Cathleen R Hutchins
*Assistant Examiner* — Ronald R Runyan
(74) *Attorney, Agent, or Firm* — Leydig, Voit & Mayer, Ltd.

(57) ABSTRACT

A system for compensating for a slope of a work surface while drilling holes in the work surface includes a leveling system, a rotary drill mechanism, a position sensor, an inclination sensor, and controller. The controller is configured to access coordinates of a desired map drill hole, determine current coordinates of a machine reference, and determine a current slope of the machine. A dynamic offset compensation is determined to compensate for movement of the rotary drill mechanism by the leveling system from a first position offset from the desired map drill hole to a second position aligned with the desired map drill hole, with the dynamic offset compensation being based upon the characteristics and the current slope of the machine. Upon the rotary drill mechanism being aligned with the first position, generating a leveling command to move the machine so that the rotary drill mechanism is aligned with the desired map drill hole.

20 Claims, 9 Drawing Sheets

SLOPE COMPENSATION SYSTEM FOR ROTARY DRILL MACHINES

TECHNICAL FIELD

This disclosure relates generally to rotary drill machines, and more particularly, to a system operative to position the machines to compensate for drilling holes on sloped surfaces.

BACKGROUND

Rotary drill machines or rotary blast hole drills are often used in surface mining operations to drill holes into which explosives are inserted. The machines typically include a frame or platform on which a pivotable mast supporting a rotatable drill bit is mounted. A drive mechanism is provided to propel the machine from one drill hole location to the next.

A leveling system may be operatively connected to the platform so that the platform, and thus the mast and drill bit, may be positioned at the desired orientation (e.g., horizontal) in preparation for a drilling operation. In some embodiments, the leveling system includes a plurality of hydraulic actuators operatively connected to a hydraulic system and operative to independently raise each actuator a desired amount.

Upon positioning the rotary drill machine at a desired location, actuation of the leveling system may cause a shift in the location at which the drill bit will engage the work surface. Depending upon the extent of the slope of the work surface on which the rotary drill machine is positioned, the result of the leveling process may be significant movement of the drill bit away from its desired location. This issue may become more significant when the rotary drill machine is being moved in an autonomous manner. In such case, repositioning the machine may be difficult and/or impractical.

U.S. Patent Publication No. 2017/0234119 discloses a system for automatically leveling a machine including using an electronic processor to autonomously change a position of at least one of a plurality of jacks to level the machine. The system may extend at least one of the plurality of jacks or retract at least one of the plurality of jacks. Such leveling operation is performed after the machine is positioned at a desired location.

The foregoing background discussion is intended solely to aid the reader. It is not intended to limit the innovations described herein, nor to limit or expand the prior art discussed. Thus, the foregoing discussion should not be taken to indicate that any particular element of a prior system is unsuitable for use with the innovations described herein, nor is it intended to indicate that any element is essential in implementing the innovations described herein. The implementations and application of the innovations described herein are defined by the appended claims.

SUMMARY

In one aspect, a system for compensating for a slope of a work surface on which a machine is disposed while drilling holes in the work surface includes a leveling system, a rotary drill mechanism, a position sensor, an inclination sensor, and controller. The leveling system is operatively connected to the machine and configured to move the machine to a desired orientation. The rotary drill mechanism is operatively connected to the leveling system and configured to drill holes in the work surface. The position sensor is operatively associated with the machine and configured to generate position signals indicative of a position of the machine. The inclination sensor is operatively associated with the machine and configured to generate slope signals indicative of a slope of the work surface adjacent the machine. The controller is configured to access characteristics of the machine including a position of a machine reference relative to the rotary drill mechanism, the leveling system, and the position sensor, access coordinates of a desired map drill hole, determine current coordinates of the machine reference based upon the position signals from the position sensor, and determine a current slope of the machine based upon the slope signals from the inclination sensor. The controller is further configured to determine a dynamic offset compensation to compensate for movement of the rotary drill mechanism by the leveling system from a first position offset from the desired map drill hole to a second position aligned with the desired map drill hole, with the dynamic offset compensation being based upon the characteristics of the machine and the current slope of the machine, generate a drive command to propel the machine and move the machine reference to a position at which the rotary drill mechanism is aligned with the first position, and generate a leveling command to operate the leveling system to move the machine to the desired orientation at which the rotary drill mechanism is aligned with the desired map drill hole.

In another aspect, a method of compensating for a slope of a work surface on which a machine is disposed while drilling holes in the work surface with a rotary drill mechanism operatively associated with a leveling system includes accessing characteristics of the machine including a position of a machine reference relative to the rotary drill mechanism, the leveling system, and a position sensor, accessing coordinates of a desired map drill hole, determining current coordinates of the machine reference based upon position signals from the position sensor, and determining a current slope of the machine based upon slope signals from a slope sensor. The method further includes determining a dynamic offset compensation to compensate for movement of the rotary drill mechanism by the leveling system from a first position offset from the desired map drill hole to a second position aligned with the desired map drill hole, with the dynamic offset compensation being based upon the characteristics of the machine and the current slope of the machine, generating a drive command to propel the machine and move the machine reference to a position at which the rotary drill mechanism is aligned with the first position, and generating a leveling command to operate the leveling system to move the machine to a desired orientation at which the rotary drill mechanism is aligned with the desired map drill hole.

In still another aspect, a machine includes a ground engaging drive mechanism, a leveling system, a rotary drill mechanism, a position sensor, an inclination sensor, and controller. The ground engaging drive mechanism is operatively connected to the machine and configured to propel the machine about a work site. The leveling system is operatively connected to the machine and configured to move the machine to a desired orientation. The rotary drill mechanism is operatively connected to the leveling system and configured to drill holes in the work surface. The position sensor is operatively associated with the machine and configured to generate position signals indicative of a position of the machine. The inclination sensor is operatively associated with the machine and configured to generate slope signals indicative of a slope of the work surface adjacent the machine. The controller is configured to access characteristics of the machine including a position of a machine reference relative to the rotary drill mechanism, the leveling system, and the position sensor, access coordinates of a desired map drill hole, determine current coordinates of the machine reference based upon the position signals from the position sensor, and determine a current slope of the machine based upon the slope signals from the inclination sensor. The controller is further configured to determine a dynamic offset compensation to compensate for movement of the rotary drill mechanism by the leveling system from a first position offset from the desired map drill hole to a second position aligned with the desired map drill hole, with the dynamic offset compensation being based upon the characteristics of the machine and the current slope of the machine, generate a drive command to propel the machine and move the machine reference to a position at which the rotary drill mechanism is aligned with the first position, and generate a leveling command to operate the leveling system to move the machine to the desired orientation at which the rotary drill mechanism is aligned with the desired map drill hole.

DETAILED DESCRIPTION

Figure 1:
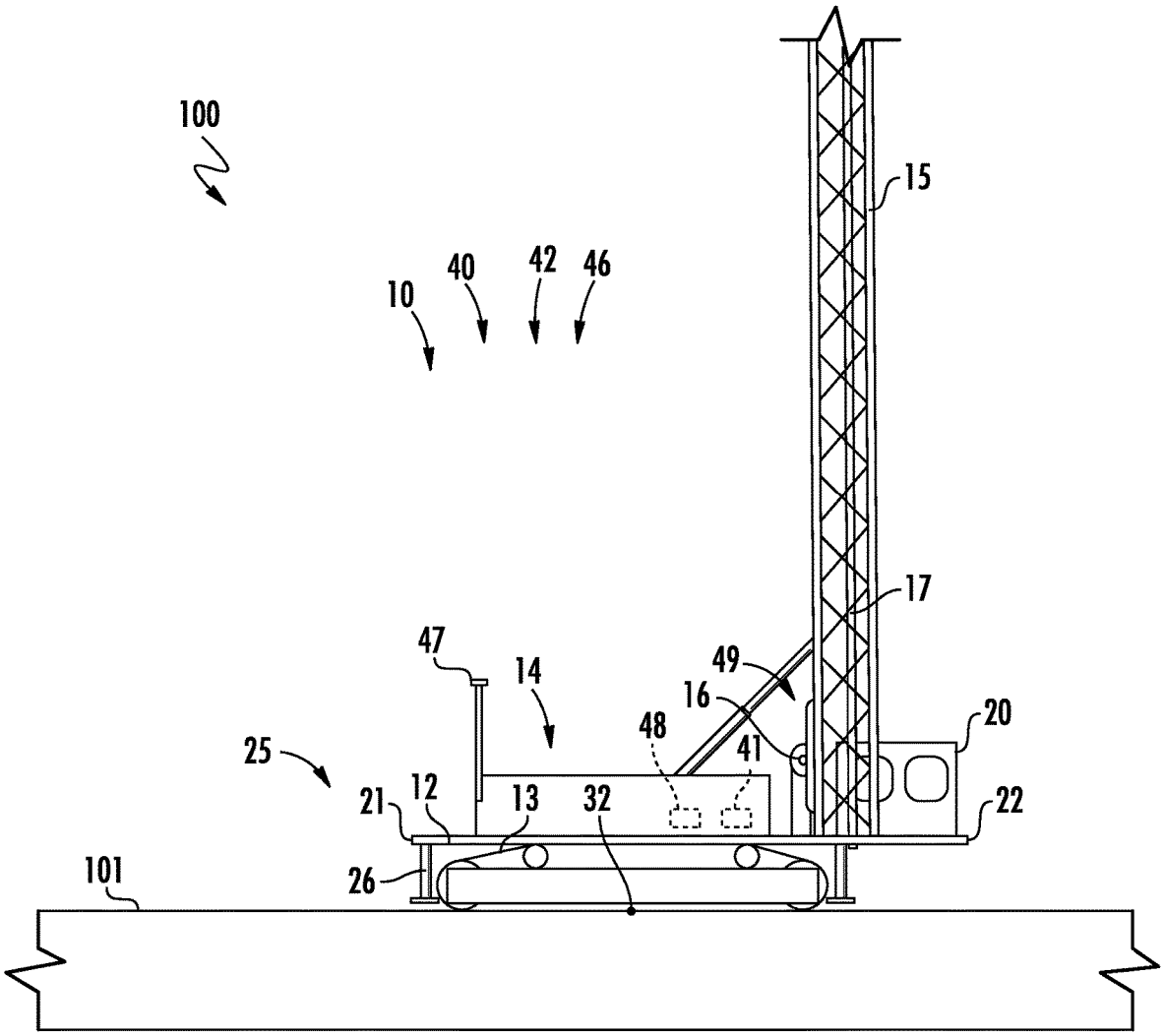
FIG. 1 is a diagrammatic side view of a rotary drill machine with which the principles disclosed herein may be used.
Figure 2:
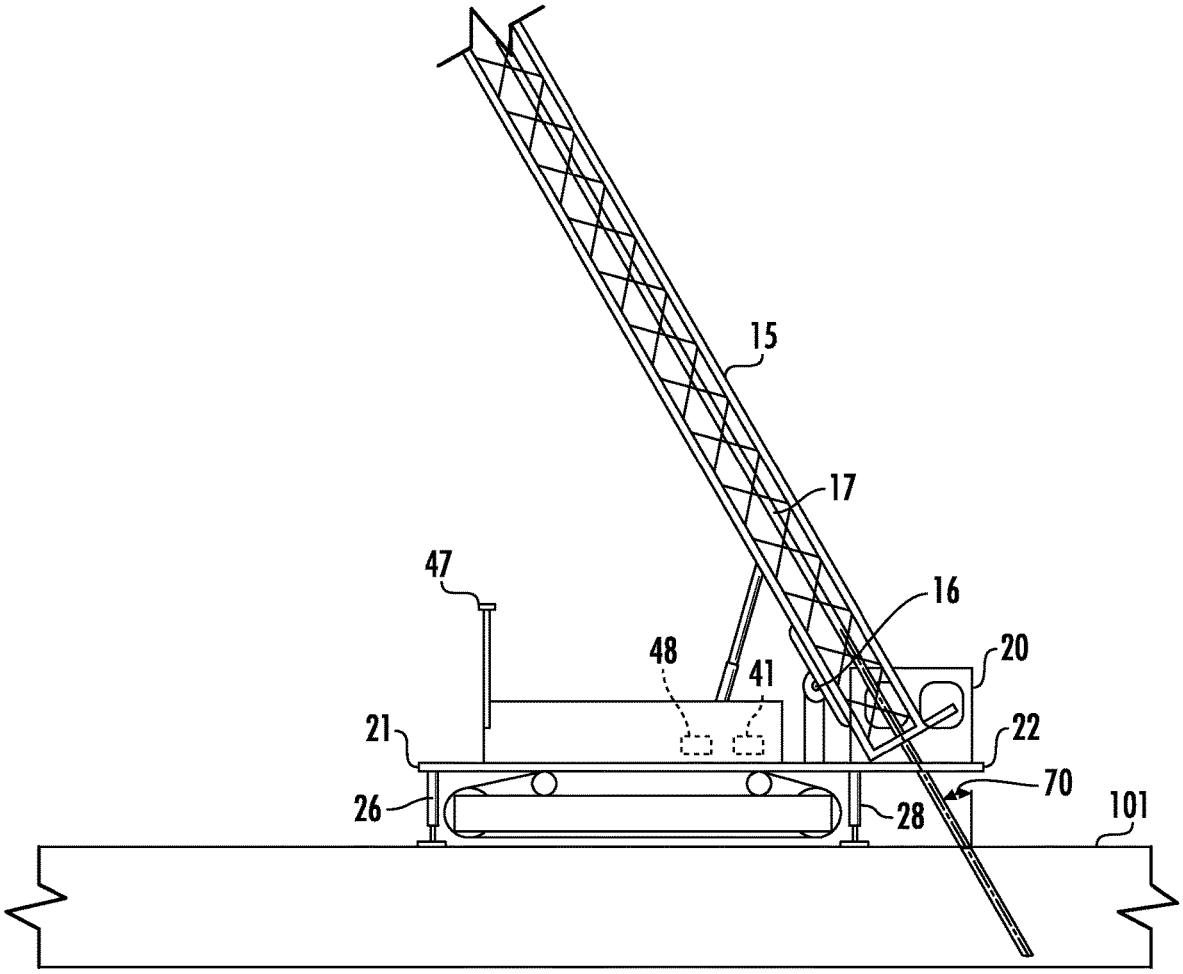
FIG. 2 is a diagrammatic view of the machine of FIG. 1 but with the machine drilling a hole at an angle to a horizontal work surface.

FIG. 1 depicts an exemplary machine 10, configured as a rotary blast hole drill. Rotary blast hole drills are often used in mining operations to drill holes into which explosives may be inserted during a mining operation. Machine 10 may include a frame 12 supported on a ground engaging drive mechanism such as tracks 13 that are operatively connected to a propulsion system generally indicated at 14 by an arrow indicating association with the machine 10 for propelling the machine about a work site 100. The machine 10 further includes a mast 15 pivotably mounted about mast pivot point 16 on the frame 12 and movable between a vertical drilling position, as depicted in FIG. 1, and a horizontal transport position (not shown). Mast 15 supports a rotary drill mechanism such as a drill bit 17 for rotation and movement into a work surface 101 at the work site 100 during a drilling operation. As depicted in FIG. 2, the machine 10 may also be capable of drilling holes at a position in which the mast 15 is not in its vertical drilling position.

A cab or operator station 20 may be provided that an operator may physically occupy and provide input to operate the machine. The mast 15 and operator station 20 are positioned towards the rear 22 of the machine 10, opposite the front 21 of the machine.

Figure 3:
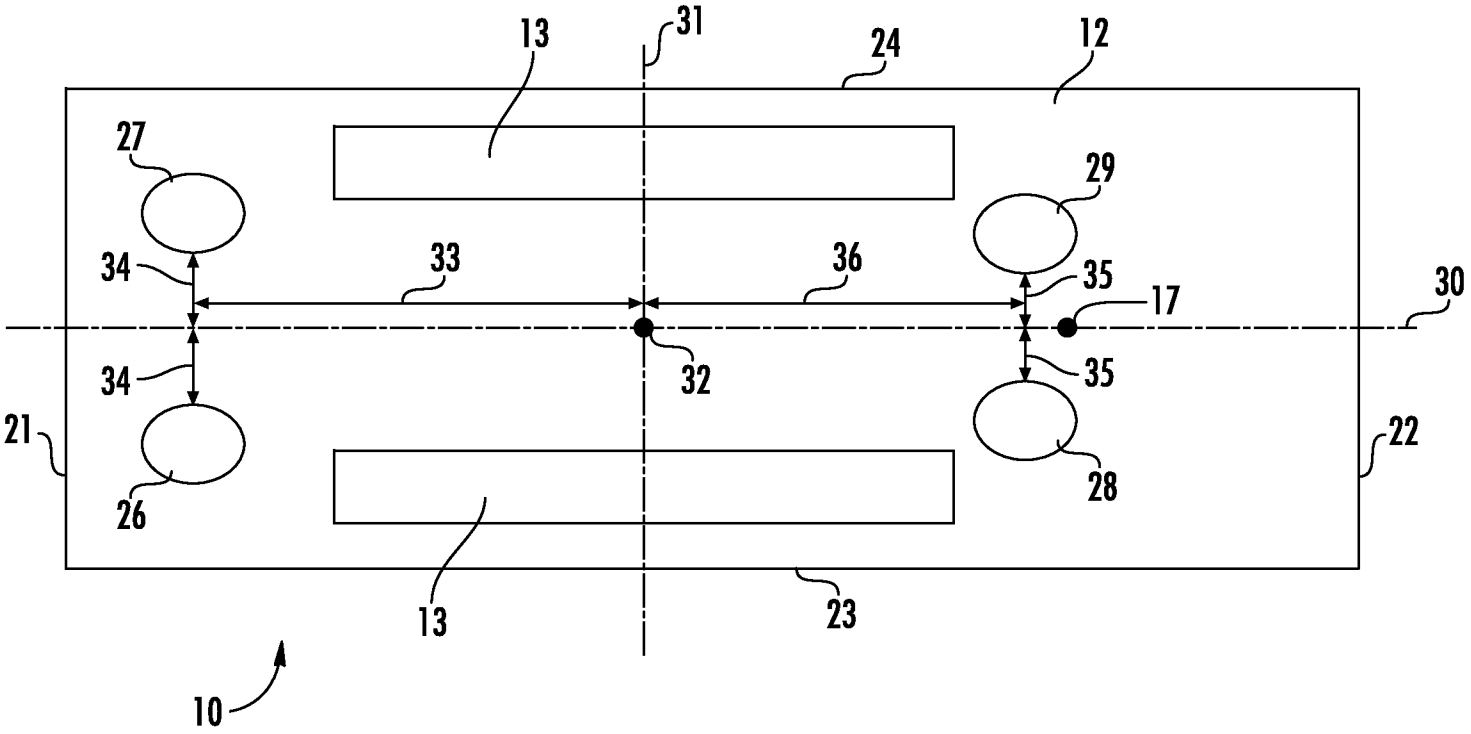
FIG. 3 is a schematic top view of the machine of FIG. 1 depicting the relationship of various elements thereof.

Machine 10 may also have a leveling system generally indicated at 25 including a plurality of jacks configured as actuators or hydraulic cylinders to raise the machine 10 above the work surface 101 during a drilling operation. Referring to FIG. 3, the left front jack is identified by reference number 26, the right front jack is identified by reference number 27, the left rear jack is identified by reference number 28, and the right rear jack is identified by reference number 29. The machine 10 may be raised to lift the machine off of the tracks 13 in order to provide additional stability for a drilling operation.

Figure 5:
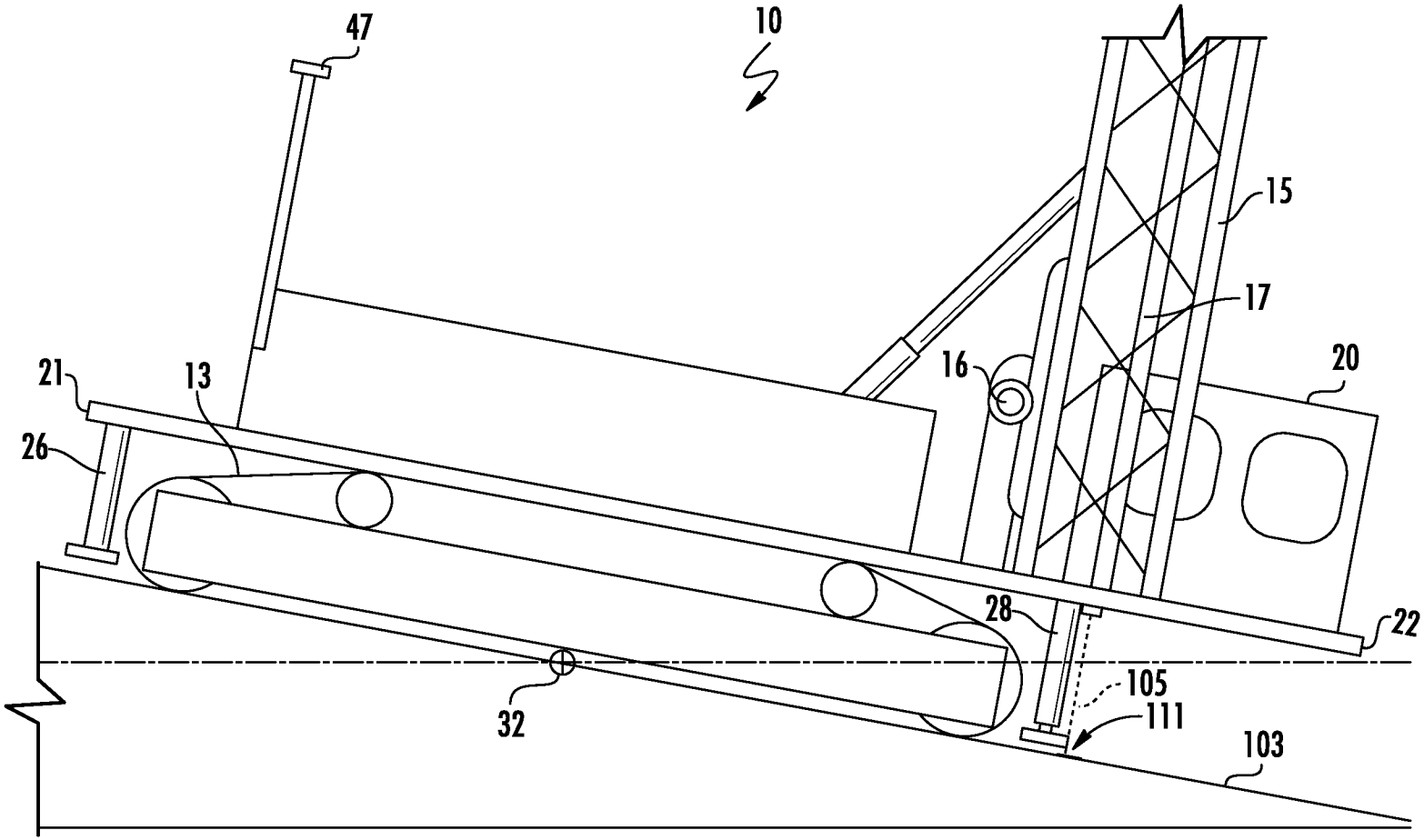
FIG. 5 is an enlarged diagrammatic view similar to FIG. 4 but with the machine positioned on a sloped surface.
Figure 6:
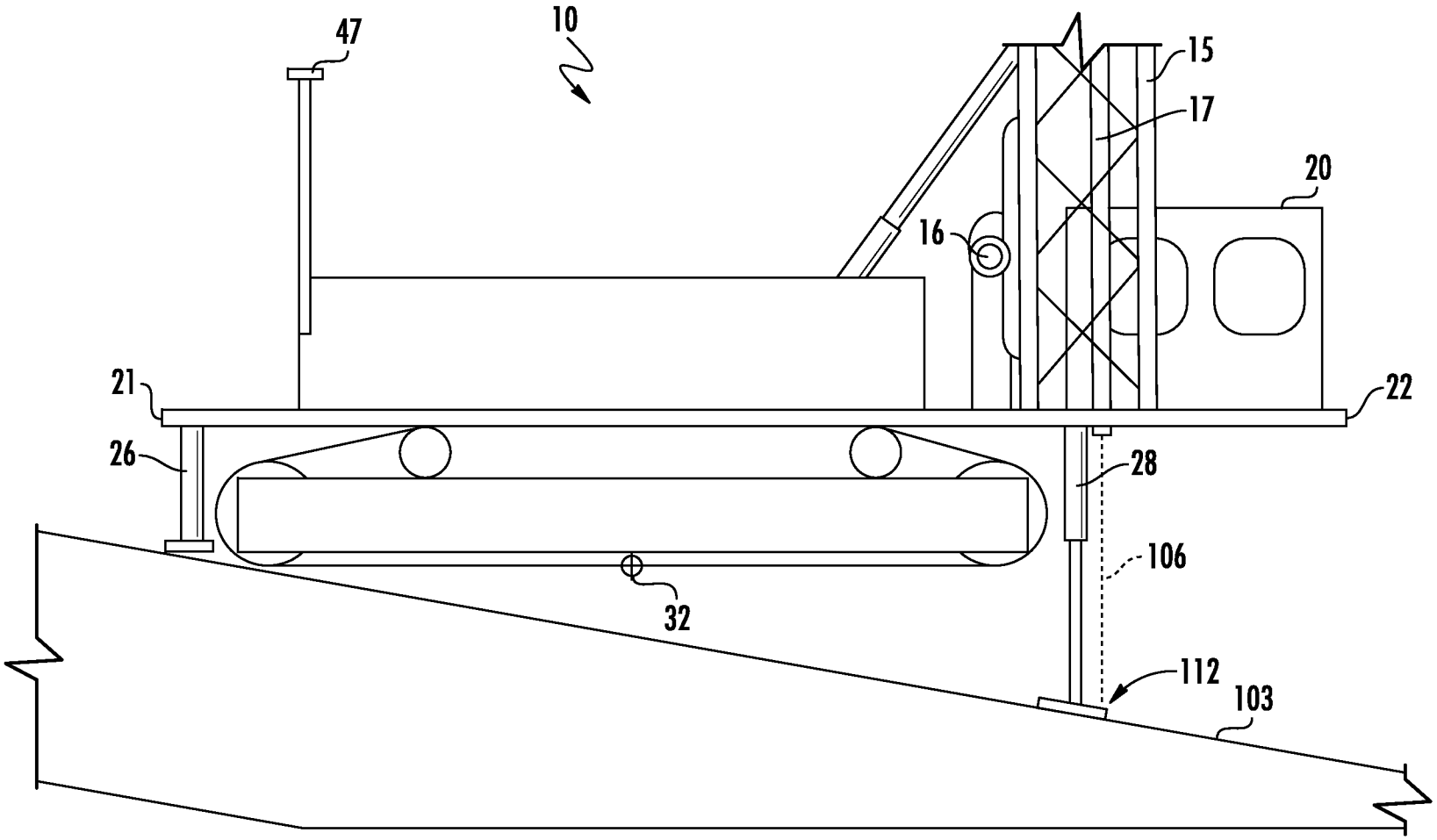
FIG. 6 is diagrammatic view similar to FIG. 5 but with one end of the machine raised relative to the work surface.
Figure 7:
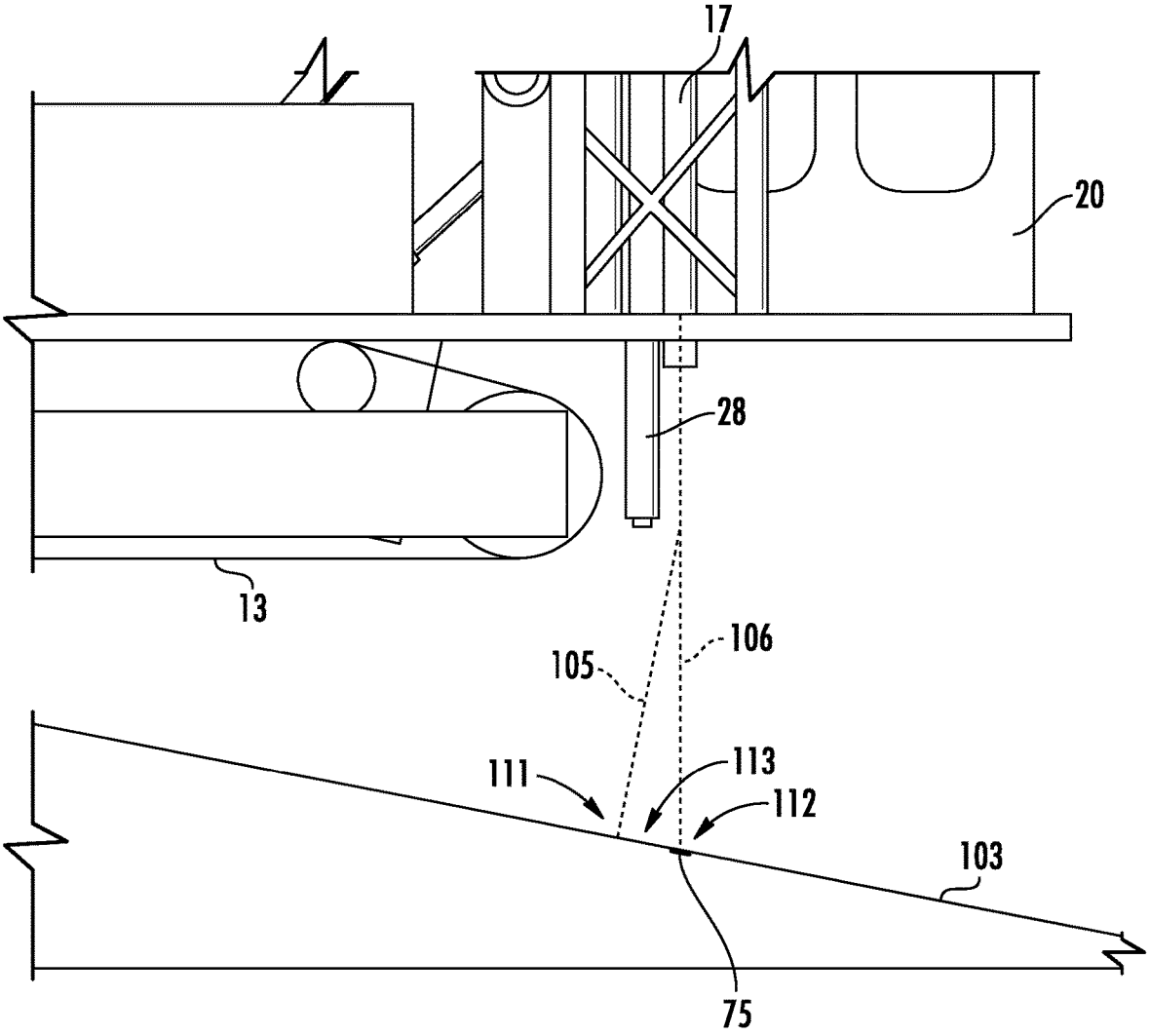
FIG. 7 is an enlarged diagrammatic view of a portion of FIG. 6 but with portions of the rear jack removed for clarity.

In addition, as depicted in FIG. 2, when operating on a level work surface 101, each of the jacks may be raised an identical amount so that the machine 10 is raised off of the tracks 13 for stability but remains horizontal during a drilling operation. However, as depicted in FIGS. 5-7, when operating on a sloped work surface 103, the jacks may be raised different amounts or distances in order to move or position the machine 10 in a horizontal position (or parallel to a desired reference plane) for a subsequent drilling operation. More specifically, in FIG. 6, the left rear jack 28 has been raised more than the left front jack 26 to position the machine in a horizontal position and, in FIG. 8, the right rear jack 29 has been raised more than the left rear jack 28 to position the machine in a horizontal position.

As depicted in FIG. 3, a longitudinal centerline 30 extends between the front 21 and rear 22 of the machine 10 and is positioned equidistantly between the tracks 13. A lateral centerline 31 extends between the left side 23 and the right side 24 of the machine 10 and is positioned at the longitudinal center of the tracks. It should be noted that the longitudinal centerline 30 and the lateral centerline 31 do not necessarily correspond to the longitudinal and lateral centerlines of the machine 10 but rather may be based upon the distances between the tracks 13 and the dimensions (i.e., the length) of the tracks. Depending on the configuration of the machine 10, the longitudinal centerline 30 and the lateral centerline 31 of the machine may or may not be centered between the jacks.

Figure 8:
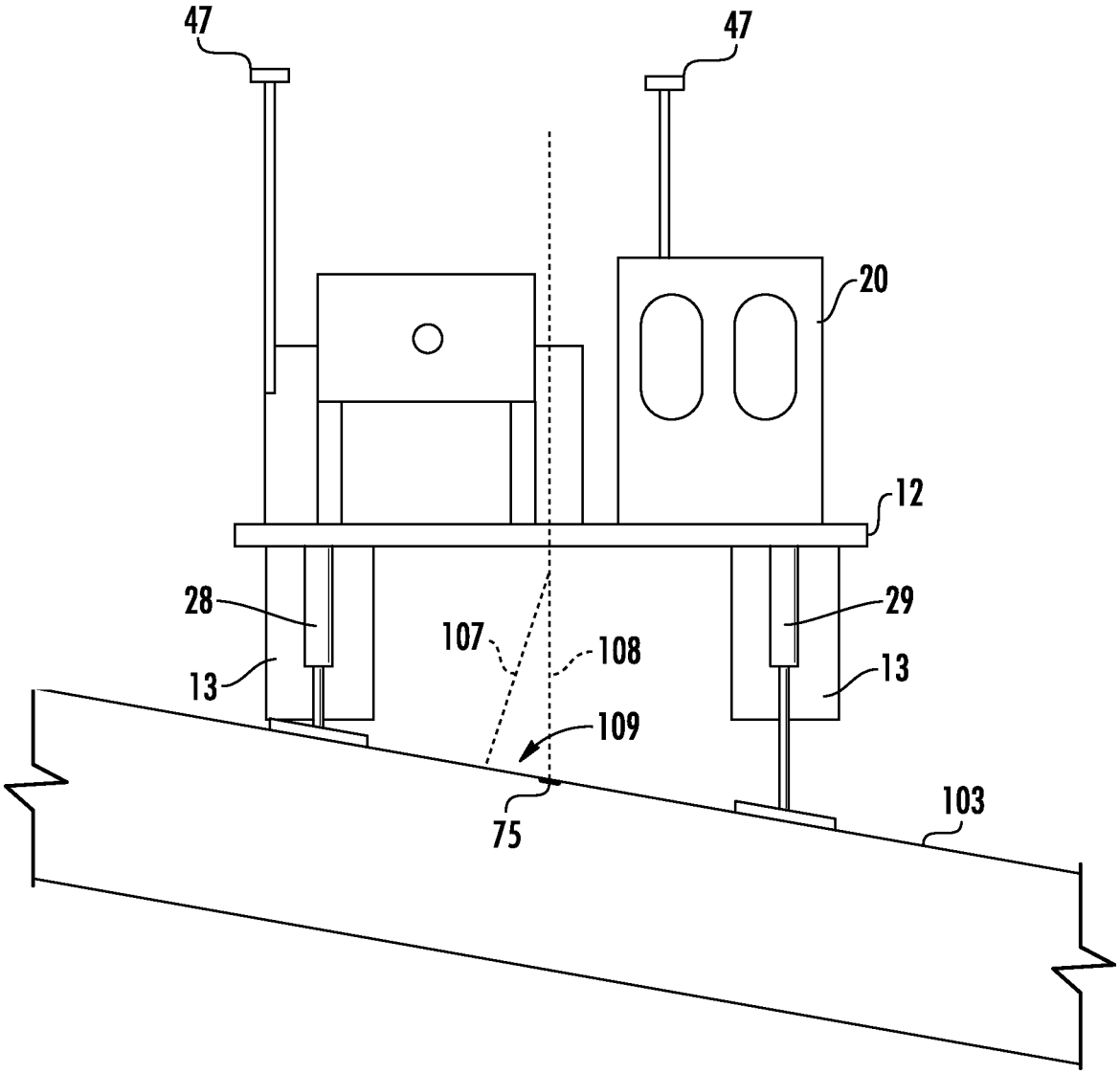
FIG. 8 is a diagrammatic rear view of the machine of FIG. 1 positioned on a second sloped surface with one end of the machine raised relative to the work surface and with certain portions removed for clarity.

Each of the left front jack 26 and the right front jack 27 is spaced from the longitudinal centerline 30 by a lateral offset 33 and from the lateral centerline 31 by a longitudinal offset 34. Each of the left rear jack 28 and the right rear jack 29 is spaced from the longitudinal centerline 30 by a lateral offset 35 and from the lateral centerline 31 by a longitudinal offset 36. In some embodiments, the drill bit 17 may, when in a vertical orientation, be offset from either or both of the longitudinal centerline 30 and the lateral centerline 31. As depicted in FIGS. 3 and 8, the drill bit 17 is offset only from the lateral centerline 31.

A control system 40, as shown generally by an arrow in FIG. 1 indicating association with the machine 10, may operate to control certain aspects of the machine and also communicate information between the machine and other machines and systems remote from the machine. The control system 40 may include an electronic control module or controller 41. The controller 41 may receive input signals from systems associated with the machine 10. The controller 41 may also receive input signals from systems outside of the machine 10 such as GPS signals. The controller 41 may control the operation of various aspects of the machine 10 as well as generate desired communications, as described in more detail below.

The controller 41 may be an electronic controller that operates in a logical fashion to perform operations, execute control algorithms, store and retrieve data and other desired operations. The controller 41 may include or access memory, secondary storage devices, processors, and any other components for running an application. The memory and secondary storage devices may be in the form of read-only memory (ROM) or random access memory (RAM) or integrated circuitry that is accessible by the controller. Various other circuits may be associated with the controller 41 such as power supply circuitry, signal conditioning circuitry, driver circuitry, and other types of circuitry.

The controller 41 may be a single controller or may include more than one controller disposed to control various functions and/or features of the machine 10. The term "controller" is meant to be used in its broadest sense to include one or more controllers and/or microprocessors that may be associated with the machine 10 and that may cooperate in controlling various functions and operations of the machine 10. The functionality of the controller 41 may be implemented in hardware and/or software without regard to the functionality. The controller 41 may rely on one or more data maps relating to the operating conditions and the operating environment of the machine 10 that may be stored in the memory of controller. Each of these data maps may include a collection of data in the form of tables, graphs, and/or equations to maximize the performance and efficiency of the machine 10 and its operation.

The control system 40 and the controller 41 may be located on the machine 10 or may be distributed so that certain functions are performed on the machine 10 and other functions are performed remotely.

Machine 10 may be configured to be operated autonomously, semi-autonomously, or manually. When operating semi-autonomously or manually, machine 10 may be operated by remote control and/or by an operator physically located within the operator station 20 of the machine. As used herein, a machine 10 operating in an autonomous manner operates automatically based upon information received from various sensors without the need for human operator input. A machine 10 operating semi-autonomously includes an operator, either within the machine or remotely, who performs some tasks or provides some input and other tasks are performed automatically and may be based upon information received from various sensors. A machine 10 being operated manually is one in which an operator is controlling all or essentially all of the functions of the machine. A machine 10 may be operated remotely by an operator (i.e., remote control) in either a manual or semi-autonomous manner.

During autonomous operation (and semi-autonomous positioning) of the machine 10, the control system 40 may be configured to position the machine based upon the position of any reference point or datum associated with the machine. In one embodiment, the control system 40 may utilize the intersection of the longitudinal centerline 30 and the lateral centerline 31 of the machine at the level of the lower surface of the tracks 13 to define a datum or machine reference 32 (FIG. 3) used to measure movement of the machine 10 as discussed below. Other locations on the machine 10 may be selected as the machine reference, if desired.

Machine 10 may be equipped with a plurality of machine sensors 45, as shown generally by an arrow in FIG. 1 indicating association with the machine, that provide data indicative (directly or indirectly) of various operating parameters of the machine, systems associated with the machine, and/or the operating environment in which the machine is operating. The term "sensor" is meant to be used in its broadest sense to include one or more sensors and related components that may cooperate to sense various functions, operations, and operating characteristics of a machine or system and/or aspects of the environment in which the machine or system is operating. In operation, a sensor may generate signals indicative of a characteristic or data being measured.

A position sensor 46, as shown generally by an arrow in FIG. 1 to indicate association with the machine 10, may be provided to sense the position and orientation (i.e., the heading or yaw) of the machine. The position sensor 46 may include a plurality of individual sensors 47 that cooperate to generate and provide position data or signals to controller 41 indicative of the position and orientation of the machine 10. The individual sensors 47 may interact with a positioning system such as a global navigation satellite system or a global positioning system to provide position sensing functionality. The controller 41 may use position signals from the position sensor 46 to determine the position or coordinates of the machine 10 relative to an earth reference (e.g., GPS). In still other examples, the position sensor 46 may include a perception based system, or may use other systems such as lasers, sonar, or radar to determine all or some aspects of the position of machine 10.

One or more slope or inclination sensors 48 such as a pitch angle sensor may be provided to generate slope data or signals indicative of the slope or inclination (i.e., pitch and roll) of the machine 10 relative to a ground or earth reference. Separate sensors may be provided for determining each of the pitch and roll of the machine or a combined sensor may provide signals to determine both pitch and roll. In other examples, the slope or inclination may be determined from data generated by the position sensor 46.

A mast angle sensor generally indicated at 49 may be provided to sense the angle 70 (FIG. 2) of the mast 15 relative to the machine 10. In one embodiment, a mast angle 70 of 0 degrees as depicted in FIG. 1 indicates that the mast 15 is vertical relative to the machine. Although the mast angle 70 may be 0 degrees in many or most drilling operations, the machine 10 may be configured to permit drilling when the mast angle is at other angles as depicted in FIG. 2.

Figure 4:
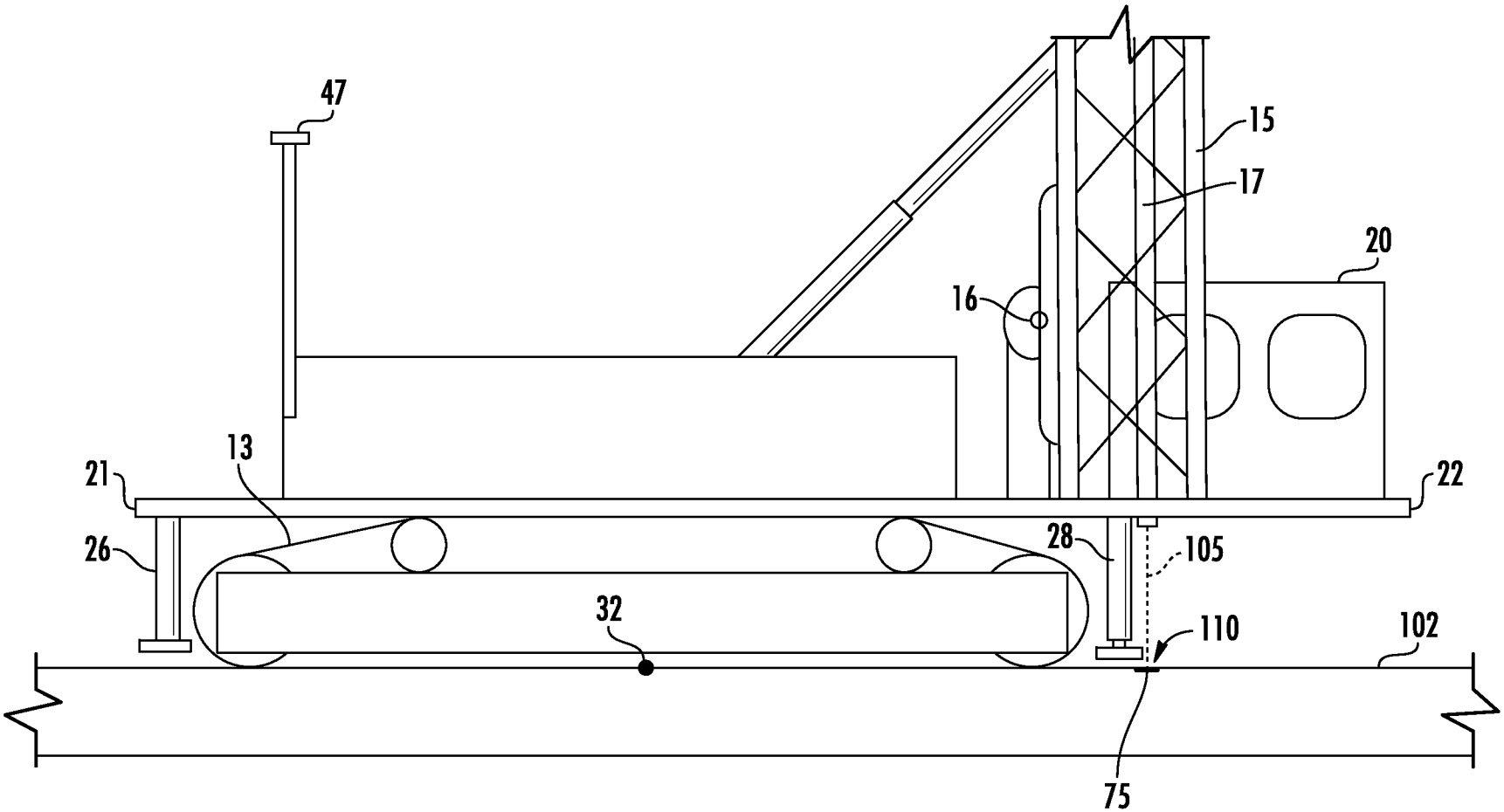
FIG. 4 is an enlarged diagrammatic view of a portion of FIG. 1.

Referring to FIG. 4, upon positioning the machine 10 on a horizontal work surface 102 as a result of movement by the propulsion system 14, the intersection 110 of the bit projection 105 (i.e., the projection of the path of the drill bit 17) with the horizontal work surface 102 will be vertically below the lower surface of the drill bit 17. Prior to beginning a drilling operation, the jacks may be uniformly raised so that the machine 10 remains horizontal and the positions of the bit projection 105 and the intersection 110 do not change as a result of the jacking operation. In such case, it is desirable to position the machine 10 with the bit projection 105 aligned with the location of the map drill hole 75 (i.e., the hole location stored in a worksite planning map or generated by a worksite planning system). The machine 10 may be subsequently raised by the jacks and a drilling operation performed. In doing so, the positions of the bit projection 105 and the intersection 110 at the time the propulsion system 14 stops moving the machine 10 should correspond to the location of the map drill hole 75.

Upon positioning the machine 10 on a sloped work surface 103 as depicted in FIG. 5, the bit projection 105 extends towards the work surface so that the bit projection and the work surface intersect at a right angle. However, due to the slope of the work surface 103, the intersection 111 of the bit projection 105 and the work surface is not vertically below the lower surface of the drill bit 17.

Further, in order to re-orient the machine to a horizontal position, the jacks are raised in a non-uniform manner as depicted in FIG. 6. For example, the left rear jack 28 and right rear jack 29 are raised more than the left front jack 26 and the right front jack 27 to re-orient the machine to a horizontal position. Upon raising the rear jacks so that the machine 10 is re-oriented to a horizontal position, the bit projection, illustrated at 106, will rotate with the machine 10 and the intersection between the rotated bit projection and the sloped work surface 103 will shift laterally from its original position as depicted at 111 to a subsequent position depicted at 112. Referring to FIG. 7, the shift 113 between the intersection 111 and the intersection 112 is depicted. As used herein, the shift 113 of the intersections 111, 112 as a result of the leveling or re-orienting of the machine 10 on the sloped work surface 103 may be referred to as a "dynamic offset."

It should be noted that in addition to the sloped work surface 103 being pitched from front to rear relative to the machine 10 as depicted in FIGS. 5-7, the work surface may also be sloped in a transverse direction relative to the pitch (i.e., roll) as depicted in FIG. 8. The unleveled or unrotated bit projection is illustrated at 107 and the leveled or rotated bit projection is illustrated at 108. As depicted in FIG. 8, leveling the machine 10 results in a dynamic offset 109 based upon the roll of the machine 10.

Depending upon the configuration of the work surface 101, the machine 10 may experience both pitch and roll relative to a horizontal plane. As a result, re-orienting the machine 10 to a horizontal position may require raising each of the jacks in a non-uniform manner (i.e., each of the jacks may be raised a different amount) to compensate for both the pitch and roll of the machine. Accordingly, the dynamic offset may include a shift in both the "x" and "y" directions as a result of the pitch and roll of the sloped work surface 103.

As a result of the dynamic offset, positioning the machine 10 at a desired location for drilling a hole in the work surface without requiring subsequent re-alignment may be challenging or problematic. More specifically, upon positioning the machine 10 on a sloped surface 103 so that the bit projection 105 is aligned with the location of the map drill hole 75, subsequent re-orienting of the machine to a horizontal position will move the bit projection away from the desired hole location. If the slope (i.e., pitch and roll) is significant, the bit projection 105 may move a significant distance away from the location of the map drill hole 75 during the re-orienting or leveling process. Subsequent drilling, without re-positioning the machine 10 prior to the leveling process would then result in the hole being drilled at a location offset from the map drill hole 75 location. Control system 40 may therefore include a dynamic offset compensation system generally indicated at 42 in FIG. 1 that is operative to compensate for dynamic offset caused by operating the machine on a sloped surface and adjust a target position of the machine 10 for use while propelling the machine.

The dynamic offset compensation system 42 may generally operate by determining the dynamic offset as a result of a sloped work surface 103 on which the machine 10 is operating and then determining the actual or target position to which the machine 10 should be propelled so that, upon leveling of the machine, the rotated bit projection 106 is aligned with the position of the map drill hole 75.

INDUSTRIAL APPLICABILITY

The industrial applicability of the system described herein will be readily appreciated from the foregoing discussion. The foregoing discussion is applicable to machines 10, such as a rotary blast hole drills, that operate at a work site 100 for drilling holes in the work surface 101. The systems and processes disclosed herein may be used at a mining site, a landfill, a quarry, a construction site, a roadwork site, or any other area or site in which it is desired drill holes in a work surface.

Figure 9:
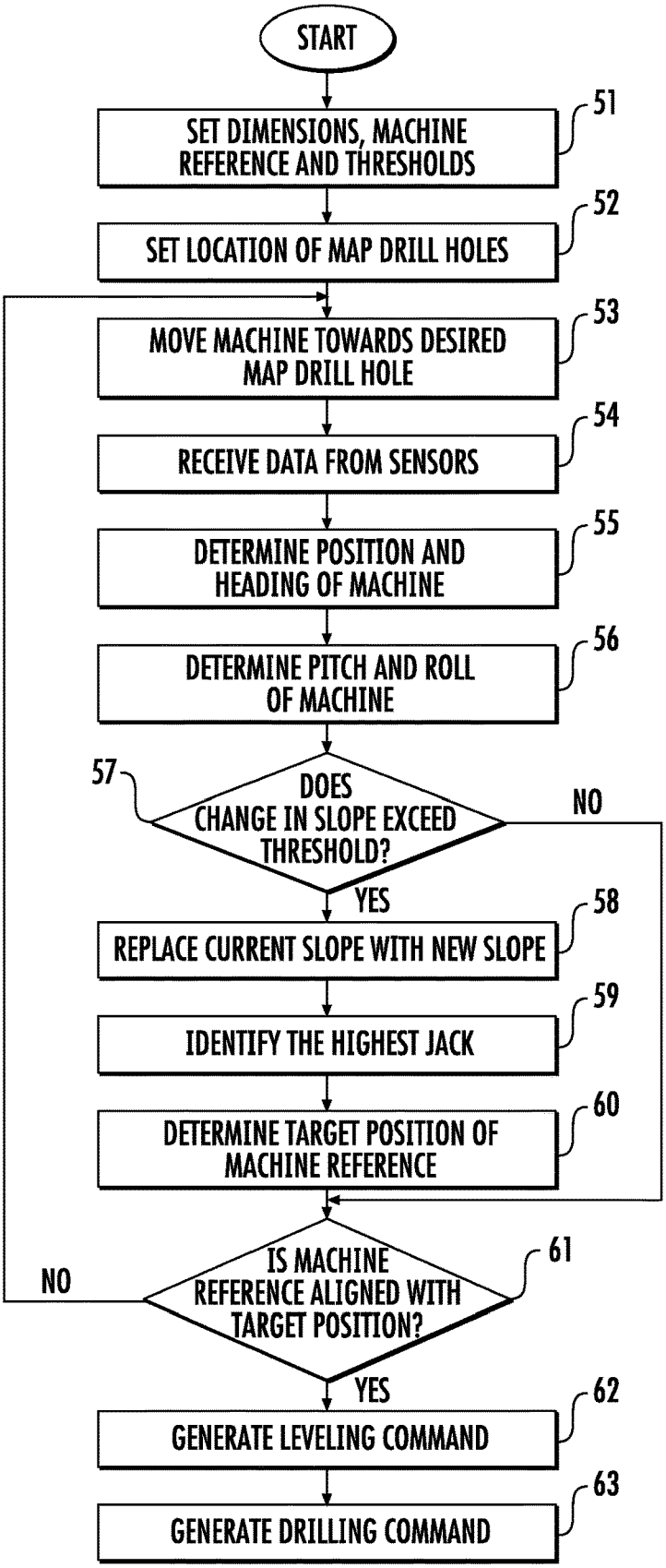
FIG. 9 is a flowchart of an exemplary process of drilling a blast hole in accordance with the disclosure.

FIG. 9 depicts a flowchart of one example of the operation of the dynamic offset compensation system 42. At stage 51, various dimensions of the machine 10 and certain operating thresholds may be set or stored such as within controller 41. For example, the distance from the drill bit 17 (when vertical) to the lateral centerline 31, the lateral offset 33 and the longitudinal offset 34 of each of the left front jack 26 and the right front jack 27 as well as the lateral offset 35 and the longitudinal offset 36 of each of the left rear jack 28 and the right rear jack 29 may be set or stored. In addition, distances related to the mast pivot point 16 such as the distance to from the mast pivot point to the drill bit 17, and the distance from the mast pivot point to the top of the frame 12 may also be set or stored. Further, the distance between the individual sensors 47 of the position sensor 46 and the machine reference 32 (the intersection of the longitudinal centerline 30 and the lateral centerline 31 at the level of the lower surface of the tracks 13) may also be set or stored so that the position of the machine reference may be determined based upon the position signals. Still further, a slope change threshold for determining a material change in pitch and roll of the machine 10 may also be set or stored.

At stage 52, the location or coordinates of the desired holes to be drilled in the work surface 101 may be set or stored. Such holes may be referred to as map drill holes 75 and the position of each map drill hole may be expressed in terms of an "x" position such as $X_{map}$ and a "y" position such as $Y_{map}$. In one embodiment, the coordinates of the desired map drill holes 75 may be stored as part of a work site map. Other manners of determining the desired locations of the map drill holes 75 are contemplated.

At stage 53, the controller 41 may access the coordinates of and move the machine 10 towards the next desired map drill hole 75. While doing so, the controller 41 may receive at stage 54 data from the sensors associated with the machine 10 including the position sensor 46, the inclination sensor 48, and the mast angle sensor 49. The controller 41 may determine at stage 55 the position and heading of the machine 10 based upon the position data from the position sensor 46 and the angle of the mast 15 based upon angle signals from the mast angle sensor 49.

More specifically, based upon the distances between the individual sensors 47 of the position sensor 46 and the machine reference 32, the position and heading of the machine reference may be determined from the position signals. Further, the controller 41 may determine the position or current coordinates of the machine reference 32 from the position data. In addition, based upon the distance between the drill bit 17, when vertical, and the position of the machine reference 32, the position of the drill projection 105 may also be determined.

At stage 56, the controller 41 may determine the slope (i.e., pitch and roll) of the machine 10 based upon slope signals from the inclination sensor 48. The controller 41 may determine at decision stage 57 whether the difference between the current pitch and roll of the machine 10 and the previously stored pitch and roll of the machine exceeds a slope change threshold. If the difference between the current pitch and roll and the previously stored pitch and roll is less than a predetermined slope change threshold, the controller 41 may skip to stage 61 and continue to operate based upon the previously stored pitch and roll. In one embodiment, the angle threshold may be one degree. The difference between the current pitch and roll and the previously stored pitch and roll may be determined according to the following:

$$\Delta=|(|\text{Pitch}_{old}|+|\text{Roll}_{old}|)-(|\text{Pitch}_{new}|)+|\text{Roll}_{new}|| \quad (1)$$

where Δ is the difference between the current pitch and roll and the previously stored pitch and roll, $\text{Pitch}_{old}$ is the previously stored pitch, $\text{Roll}_{old}$ is the previously stored roll, $\text{Pitch}_{new}$ is the current pitch, and $\text{Roll}_{new}$ is the current roll.

If the difference A between the sum of the current pitch and roll and the sum of the previously stored pitch and roll is greater than the predetermined slope change threshold, the controller 41 may replace at stage 58 the previously stored pitch and roll with the current pitch and roll.

After the replacing the current slope data with the new slope data, the controller 41 may determine, based upon the new pitch and roll of the machine 10, a target position offset from the desired map drill hole to account or compensate for the dynamic offset caused by the sloped work surface 103. In other words, the controller 41 may determine the position at which the machine 10 or bit projection 105 should be positioned so that, upon leveling the machine, the rotated bit projection will be aligned with the map drill hole 75. In doing so, the controller 41 may determine the desired position of the machine reference 32 to position the bit projection 105 at the position offset from the desired map drill hole.

More specifically, when extending certain jacks to level the machine 10 and compensate for the dynamic offset caused by a sloped work surface 103, the machine will generally rotate about the jack positioned at the highest elevation on the work surface. In some instances, the highest jack may also be raised with the other jacks during the leveling process but the overall movement of the machine may be generalized as rotation. In other words, even if the machine 10 is not being strictly rotated as the jacks are being extended to level the machine, such movement may be approximated and may be referred to herein as rotation of the machine. The portion of the machine 10 adjacent the highest jack may be subjected to the least amount of movement during the leveling process and thus the use of the highest jack as a reference for determining the compensation for the dynamic offset may be desirable as it may simplify the analysis of the movement of the machine 10 and thus simplify the calculation of the dynamic offset compensation.

At stage 59, the controller 41 may analyze the topography of the work surface adjacent the machine 10 to determine the highest elevation on which the jacks are currently positioned. In other words, the controller 41 may determine, prior to raising the jacks to level the machine 10, which jack (e.g., the upper surface thereof) is at the highest elevation. In one embodiment, the controller 41 may determine whether the pitch of the machine 10 is positive or negative. Based upon one standard pitch convention, if the pitch is positive, the front 21 of the machine is higher than the rear 22 and, if the pitch is negative, the rear of the machine is higher than the front. Based upon one standard roll convention, if the roll is positive, the left side 23 of the machine is higher than the right side 24 and, if the roll is negative, the right side is higher than the left side. As a result, the highest jack may be determined based upon the logic set forth in the following table:

| Highest Jack | Pitch | Roll |
|---|---|---|
| Left Front | + | + |
| Right Front | + | − |
| Left Rear | − | + |
| Right Rear | − | − |

The target position for the machine reference 32 (expressed as $X_{target}, Y_{target}, Z_{target}$) may be determined at stage 60. More specifically, by positioning the machine 10 so that the machine reference 32 is at its target position, the drill projection 105 will be offset from the map drill hole 75 but upon rotating the machine 10 to a horizontal position, the rotated bit projection 106 will be aligned with the map drill hole 75 location.

To determine the target position for the machine reference 32, desired coordinates (expressed as $X_1$, $Y_1$, $Z_1$) of the top of the highest jack (i.e., the intersection of the highest jack and the frame 12) may be determined in terms of the coordinates of the target position, the pitch and roll of the machine 10, and the dimensions of the machine.

More specifically, $X_1$ may be expressed as:

$$X_1=X_{map}+(X_{Jackoffset}+X_{Bitoffset})*\text{Sin(targetyaw)}+Y_{Jackoffset}*\text{Cos(targetyaw)} \quad (2)$$

where $X_{Jackoffset}$ is the length of the longitudinal offset 33, 36 between the machine reference 32 and the highest jack, $X_{Bitoffset}$ is distance along the longitudinal centerline 30 from the drill bit 17 (when in a vertical position) and the machine reference 32, targetyaw is the desired angle of the yaw of the machine 10, and $Y_{Jackoffset}$ is the length of the lateral offset 34, 35 between the machine reference 32 and the highest jack.

$X_{Bitoffset}$ may be expressed as:

$$X_{Bitoffset}=(\text{Jackedheight}+\text{Const}_1)*\text{Tan(targetmastangle)}+\text{Const}_2 \quad (3)$$

where Jackedheight is the distance from the work surface 101 to the machine reference 32 when the jacks are raised or extended, targetmastangle is the desired mast angle 70, and $\text{Const}_1$ and $\text{Const}_2$ are set based upon the geometry or dimensions of the machine 10.

$\text{Const}_1$ may be expressed as:

$$\text{Const}_1=\text{Platformheight}+\text{Mastpivotfromframe} \quad (4)$$

where Platformheight is the distance from the work surface 101 to the frame 12 when the jacks are not raised or extended and Mastpivotfromframe is the distance from the frame to the mast pivot point 16.

$\text{Const}_2$ may be expressed as:

$$\text{Const}_2=\text{Steeltomastpivotpoint/Cos(targetmastangle)}+\text{Mastpivotpointongitudinaloffset} \quad (5)$$

where Steeltomastpivotpoint is the shortest distance from the mast pivot point 16 to the drill bit 17, and mastpivotpointlongitudinaloffset is the longitudinal distance between the mast pivot point 16 and the lateral centerline 31.

$Y_1$ may be expressed as:

$$Y_1=Y_{map}(X_{Jackoffset}+X_{Bitoffset})*\text{Cos(targetyaw)}-Y_{jackoffset}*\text{Sin(targetyaw)} \quad (6)$$

$Z_1$ may be expressed as:

$$Z_1=\text{elevation}+Z_{jackoffset} \quad (7)$$

where elevation is the Z coordinate of the GPS reading at machine reference 32 and $Z_{Jackoffset}$ is the distance from the work surface 101 to the machine reference when the jacks are raised. $Z_{jackoffset}$ may be expressed as:

$$Z_{Jackoffset}=(X_{Jackoffset}+X_{Bitoffset})*\text{Sin(pitch)}-y_{Jackoffset}*\text{Cos(pitch)}*\text{Sin(roll)}+\text{Const3} \quad (8)$$

where $\text{Const}_3$ is the Platformheight.

The components of the target position ($X_{target}$, $Y_{target}$, $Z_{target}$) may then be expressed as:

$$X_{target}=X_1+X_{Jackoffset})*\text{Cos(pitch)}*\text{Sin(targetyaw)}+(-Y_{Jackoffset})*[\text{Cos(targetyaw)}*\text{Cos(roll)}+\text{Sin(targetyaw)}*\text{Sin(pitch)}*\text{Sin(roll)}]+\text{Const}_3*[-\text{Cos(targetyaw)}*\text{Sin(roll)}+\text{Sin(targetyaw)}*\text{Sin(pitch)}*\text{Cos(roll)}] \quad (9)$$

where pitch is the pitch of the machine 10 as sensed by the inclination sensor 48 and roll is the roll of the machine 10 as sensed by the inclination sensor 48.

$$Y_{target}=Y_1+X_{Jackoffset})*\text{Cos(pitch)}*\text{Cos(targetyaw)}+(-Y_{Jackoffset})[-\text{Sin(targetyaw)}*\text{Cos(roll)}+\text{Cos(targetyaw)}*\text{Sin(pitch)}*\text{Sin(roll)}]+\text{Const3}*[\text{Sin(targetyaw)}*\text{Sin(roll)}+\text{Cos(targetyaw)}*\text{Sin(pitch)}*\text{Cos(roll)}] \quad (10)$$

$$Z_{target}=Z_1+(X_{Jackoffset})*\text{Sin(pitch)}-(-Y_{Jackoffset})*\text{Cos(pitch)}*\text{Sin(roll)}-\text{Const}_3*\text{Cos(pitch)}*\text{Cos(roll)} \quad (11)$$

Once the target position $X_{target}$,$Y_{target}$,$Z_{target}$ of the machine 10 has been determined, controller 41 may determine at decision stage 61 whether the machine reference 32 is aligned with the target position. If the machine reference 32 and the target position are not aligned, the machine 10 may continue to be moved towards the target position and stages 53-61 repeated. If the machine reference 32 is aligned with the target position $X_{target}$,$Y_{target}$,$Z_{target}$ propulsion of the machine 10 may be terminated and the controller 41 may generate at stage 62 one or more lift or leveling commands to raise the jacks so that the machine 10 is level. At stage 63 a drilling command may be generated to perform a drilling operation.

Upon completion of the drilling operation, the next map drill hole 75 may be set or accessed within the controller 41 and the process continued.

Various alternative methods and embodiments are contemplated. For example, the machine reference 32 may be defined or set at any location. Although the process is described as moving the machine 10 from a sloped position to a horizontal position when leveling the machine, the process may include moving the machine to be parallel to any reference plane. Further, although the process is described and formulas provided in the context of rotating the machine about the highest jack, other points of reference may be used.

Still further, in another embodiment, the distance that the drill projection 105 will travel or be moved upon leveling the machine 10 may be determined and the coordinates of the map drill hole 75 may be adjusted based upon the movement of the drill projection to define the coordinates of the adjusted map drill hole. The machine 10 may then be propelled to align the drill projection with the adjusted map drill hole prior to the leveling operation.

It will be appreciated that the foregoing description provides examples of the disclosed system and technique. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. A system for compensating for a slope of a work surface on which a machine is disposed while drilling holes in the work surface, the system comprising:

a leveling system operatively connected to the machine and configured to move the machine to a desired orientation;

a rotary drill mechanism operatively connected to the leveling system and configured to drill holes in the work surface, the rotary drill mechanism defining a bit projection;

a position sensor operatively associated with the machine and configured to generate position signals indicative of a position of the machine;

an inclination sensor operatively associated with the machine and configured to generate slope signals indicative of a slope of the work surface adjacent the machine; and a controller configured to:

access characteristics of the machine, the characteristics including a position of a machine reference relative to the rotary drill mechanism, the leveling system, and the position sensor;

access coordinates of a desired map drill hole;

determine current coordinates of the machine reference based upon the position signals from the position sensor;

determine a current slope of the machine based upon the slope signals from the inclination sensor;

determine a dynamic offset to compensate for movement of the rotary drill mechanism upon operation of the leveling system, the dynamic offset defining a shift of an intersection of the bit projection with the work surface from a transport target location to a second location that intersects with the desired map drill hole, the transport target location being offset from the second location, and the dynamic offset being based upon the characteristics of the machine and the current slope of the machine;

generate a drive command to propel the machine and move the machine reference to a position at which the bit projection intersects with the transport target location; and generate a leveling command to operate the leveling system to move the machine to the desired orientation at which the bit projection intersects with the desired map drill hole.

2. The system of claim 1, wherein the controller is further configured to determine coordinates of a desired position of the machine reference based upon the dynamic offset.

3. The system of claim 2, wherein the drive command is further operative to move the machine to align the machine reference with a machine target position.

4. The system of claim 3, wherein the controller is further configured to autonomously drive the machine to align the machine reference with the machine target position.

5. The system of claim 1, wherein the controller is further configured to determine a rotation reference with respect to the machine and determining the dynamic offset based upon the rotation reference.

6. The system of claim 5, wherein the leveling system comprises a plurality of actuators, and the rotation reference is selected based upon one of the plurality of actuators.

7. The system of claim 6, wherein the controller is further configured to determine a highest actuator of the plurality of actuators and set the rotation reference based upon the highest actuator.

8. The system of claim 7, wherein the controller is further configured to determine coordinates associated with the highest actuator.

9. The system of claim 6, wherein the controller is further configured to set a minimum movement actuator of the plurality of actuators that will move the least based upon the leveling command and set the rotation reference based upon the minimum movement actuator.

10. The system of claim 9, wherein the controller is further configured to determine coordinates associated with the minimum movement actuator.

11. The system of claim 6, wherein the controller is further configured to set a reference actuator of the plurality of actuators and set the rotation reference based upon the reference actuator.

12. The system of claim 11, wherein the controller is further configured to determine coordinates associated with the reference actuator.

13. The system of claim 1, wherein the leveling system comprises a plurality of actuators.

14. The system of claim 13, wherein the leveling system is configured to individually control a height of each actuator.

15. The system of claim 1, wherein the controller is configured to access a slope change threshold and determine a new dynamic offset after a change in slope of the machine exceeds the slope change threshold.

16. The system of claim 15, wherein the controller is configured to determine the dynamic offset while the machine is at a location remote from the desired map drill hole and while the machine is moving towards the desired map drill hole.

17. A method of compensating for a slope of a work surface on which a machine is disposed while drilling holes in the work surface with a rotary drill mechanism operatively associated with a leveling system, the rotary drill mechanism defining a bit projection, the method comprising:

accessing characteristics of the machine, the characteristics including a position of a machine reference relative to the rotary drill mechanism, the leveling system, and a position sensor;

accessing coordinates of a desired map drill hole;

determining current coordinates of the machine reference based upon position signals from the position sensor;

determining a current slope of the machine based upon slope signals from a slope sensor;

determining a dynamic offset to compensate for movement of the rotary drill mechanism upon operation of the leveling system, the dynamic offset defining a shift of an intersection of the bit projection with the work surface from a transport target location to a second location that intersects with the desired map drill hole, the transport target location being offset from the second location, and the dynamic offset being based upon the characteristics of the machine and the current slope of the machine;

generating a drive command to propel the machine and move the machine reference to a position at which the bit projection intersects with the transport target location; and generating a leveling command to operate the leveling system to move the machine to a desired orientation at which the bit projection intersects with the desired map drill hole.

18. The method of claim 17, further including determining coordinates of a desired position of the machine reference based upon the dynamic offset and aligning the machine reference with a machine target position.

19. The method of claim 17, further including determining a rotation reference with respect to the machine and determining the dynamic offset based upon the rotation reference.

20. A machine comprising:

a ground engaging drive mechanism operatively connected to the machine and configured to propel the machine about a work site;

a leveling system operatively connected to the machine and configured to move the machine to a desired orientation;

a rotary drill mechanism operatively connected to the leveling system and configured to drill holes in a work surface, the rotary drill mechanism defining a bit projection;

a position sensor operatively associated with the machine and configured to generate position signals indicative of a position of the machine;

a slope sensor operatively associated with the machine and configured to generate slope signals indicative of a slope of the work surface adjacent the machine; and a controller configured to:

access characteristics of the machine, the characteristics including a position of a machine reference relative to the rotary drill mechanism, the leveling system, and the position sensor;

access coordinates of a desired map drill hole;

determine current coordinates of the machine reference based upon the position signals from the position sensor;

determine a current slope of the machine based upon the slope signals from the slope sensor;

determine a dynamic offset to compensate for movement of the rotary drill mechanism upon operation of the leveling system, the dynamic offset defining a shift of an intersection of the bit projection with the work surface from a transport target location to a second location that intersects with the desired map drill hole, the transport target location being offset from the second location, and the dynamic offset being based upon the characteristics of the machine and the current slope of the machine;

generate a drive command to propel the machine and move the machine reference to a position at which the bit projection intersects with the transport target location; and generate a leveling command to operate the leveling system to move the machine to the desired orientation at which the bit projection intersects with the desired map drill hole.

* * * * *